US010228216B2

(12) United States Patent
Reeves

(10) Patent No.: US 10,228,216 B2
(45) Date of Patent: Mar. 12, 2019

(54) APPARATUS FOR PROVIDING A SLING MOUNT POINT FOR A FIREARM

(71) Applicant: Miss Isle Co, Marthasville, MO (US)

(72) Inventor: Greg Reeves, Washington, MO (US)

(73) Assignee: Miss Isle Co., Marthasville, MO (US)

( * ) Notice: Subject to any disclaimer, the term of this patent is extended or adjusted under 35 U.S.C. 154(b) by 0 days.

(21) Appl. No.: 15/619,426

(22) Filed: Jun. 9, 2017

(65) Prior Publication Data

US 2018/0356185 A1 Dec. 13, 2018

(51) Int. Cl.
*F41C 33/00* (2006.01)

(52) U.S. Cl.
CPC ..... *F41C 33/007* (2013.01); *F41C 33/002* (2013.01)

(58) Field of Classification Search
CPC ..... F41C 33/00; F41C 33/002; F41C 33/005; F41C 33/006; F41C 33/007
See application file for complete search history.

(56) References Cited

U.S. PATENT DOCUMENTS 1,309,605 A * 7/1919 Badger ..... B68C 1/16 224/913
1,913,841 A * 6/1933 Lowe ..... F41C 23/02 24/265 R
2,390,522 A * 12/1945 Diffley ..... F41C 23/16 42/75.01
3,187,967 A * 6/1965 Somple ..... F41C 23/02 224/150
3,211,351 A * 10/1965 Somple ..... F41C 23/02 224/150
3,861,070 A * 1/1975 Wild ..... F41C 23/02 42/85
3,869,074 A * 3/1975 Roach ..... F41C 33/005 224/149
4,299,343 A * 11/1981 Atchisson ..... F41C 33/00 224/149
4,327,626 A * 5/1982 McQueen ..... F41A 3/54 42/72
4,555,051 A * 11/1985 Johnson ..... F41C 23/02 224/149

(Continued)

OTHER PUBLICATIONS

Illustrated Firearms Dictionary, Morris L. Hallowell, IV, Hallowell & Co., http://www.hallowellco.com/abbrevia.htm, printed on May 8, 2017 (72 pages).

(Continued)

*Primary Examiner* — Derrick R Morgan
(74) *Attorney, Agent, or Firm* — Lewis Rice LLC

(57) ABSTRACT

A device for use attaching to a long gun to provide an attaching point for a tactical sling. The device includes a mounting member configured for mounting the device to the long gun, and an attaching member configured for attaching the sling to the device. The device typically has an overall L-shaped configuration, with the mounting member and attaching member disposed at opposing ends with an extension arm therebetween. The length of the extension arm is configured so that when the device is mounted to the gun, the attaching member is disposed at a point along the major axis of the gun to cause the gun naturally to hang at an angle above vertical when hung from a sling attached to the attaching member. The angle is preferably around 45 degrees and may be any range within 0-45 degrees.

11 Claims, 8 Drawing Sheets

(56) References Cited

U.S. PATENT DOCUMENTS 4,562,945 A * 1/1986 Erlandson ..... F41C 23/02 224/150
4,571,872 A * 2/1986 Johnson ..... F41C 23/02 224/150
4,665,641 A * 5/1987 Llames ..... F41C 23/02 42/85
5,092,505 A * 3/1992 Olschlager ..... F41C 23/02 224/149
5,303,859 A * 4/1994 Jenkin ..... F41C 23/02 224/149
5,664,721 A * 9/1997 Homeyer ..... A01K 97/08 224/149
5,730,341 A * 3/1998 Hester, Jr. ..... F41B 5/1461 124/88
5,930,935 A * 8/1999 Griffin ..... F41C 27/06 42/105
5,971,239 A * 10/1999 Marable ..... F41C 33/00 224/150
6,269,577 B1 * 8/2001 Hardy ..... F41A 35/00 42/127
6,325,258 B1 * 12/2001 Verdugo ..... F41C 33/001 224/149
6,419,097 B1 * 7/2002 Anderson ..... F41A 23/18 211/85.7
6,536,153 B2 * 3/2003 Lindsey ..... F41C 33/001 224/150
6,598,330 B2 * 7/2003 Garrett ..... F41C 23/02 224/150
7,231,861 B1 * 6/2007 Gauny ..... F41A 3/72 42/16
7,752,797 B1 * 7/2010 Swan ..... F41C 23/02 42/85
7,814,697 B2 * 10/2010 Esch ..... F41C 23/02 42/85
8,312,662 B2 * 11/2012 Rogers ..... F41C 23/02 42/85
8,863,426 B1 * 10/2014 Zinsner ..... F41C 23/16 42/71.01
9,052,156 B2 * 6/2015 Nevils ..... F41C 33/001
9,052,157 B1 * 6/2015 Montes ..... F41C 23/02
9,194,655 B1 * 11/2015 Cha ..... A45F 3/14
9,587,908 B2 * 3/2017 Bjelde ..... F41C 33/007
9,835,407 B2 * 12/2017 McLean ..... F41C 23/02
2004/0188476 A1 * 9/2004 Johnson ..... F41C 33/002 224/150
2005/0188594 A1 * 9/2005 Tilby ..... F41C 23/02 42/85
2007/0278262 A1 * 12/2007 Gallagher ..... F41C 23/02 224/150
2010/0012691 A1 * 1/2010 Hyle ..... F41C 33/005 224/149
2010/0206921 A1 * 8/2010 Shen ..... F41C 33/002 224/150
2010/0287808 A1 * 11/2010 King ..... F41C 23/02 42/85
2011/0239512 A1 * 10/2011 Kleven ..... F41C 23/02 42/85
2012/0030986 A1 * 2/2012 Swan ..... F41C 23/02 42/85
2012/0055062 A1 * 3/2012 Mironichev ..... F41C 23/02 42/85
2013/0061506 A1 * 3/2013 Atkinson ..... F41C 27/00 42/90
2013/0305581 A1 * 11/2013 Smith, III ..... F41C 33/006 42/85
2014/0263489 A1 * 9/2014 Hendricks ..... F41C 33/002 224/150
2015/0292833 A1 * 10/2015 McCarthy ..... F41C 23/02 42/85

OTHER PUBLICATIONS

"SPQR-SR for Saddle Ring Leverguns," Wilderness Tactical Products, LLC webpage, http://www.thewilderness.com/single-point-system/spqd-sr-for-saddle-ring-leverguns/, printed on May 8, 2017 (2 pages).
"Mako MD-SAR Remington Ambidextrous Single Point Sling Adapter," Area 51 Products LLC webpage, http://store.a51tactical.com/index.php?main_page=product_info&products_id=1469, printed on May 8, 2017 (3 pages).
"AR 15 Single Point Sling with Adapter Plate Mount on eBay—$15.99 Free Shipping," https://gun.deals/product/ar-15-single-point-sling-adapter-plate-mount-ebay-1599-free-shipping, printed on May 8, 2017 (4 pages).
"Tactical Sling Velcro Adapter Attachment Stock Mount for Remington 870," http://www.rem870.com/2011/06/01/tactical-sling-velcro-adapter-attachment-stock-mount-for-remington-870/, printed on May 8, 2017 (12 pages).

* cited by examiner

APPARATUS FOR PROVIDING A SLING MOUNT POINT FOR A FIREARM

BACKGROUND OF THE INVENTION

Field of the Invention

This disclosure is related to the field of firearms. In particular, it relates to an apparatus for attaching a rifle or other firearm to attach a sling.

Description of the Related Art

Firearms generally are categorized as small arms (such as for use by an individual shooter) or artillery (referring to large machinery typically crewed by multiple soldiers). Within the category of small arms, firearms are subdivided into long guns and handguns. Handguns, such as revolvers and pistols, are designed to be operated using one or both hands, without the need to brace the weapon against the body during firing. Long guns, by contrast, are designed to be braced against the body for proper aiming and firing. Long guns primarily mean rifles and shotguns. This disclosure primarily concerns long guns.

Most long guns have the same general structure. Prior art long guns are depicted in FIGS. 1A-1D. On the butt end, closest to the shooter, is a stock 105, which transfers firing recoil into the body of the shooter, generally at the shoulder. Next, the receiver 103 contains most of the mechanical components of the gun, including the mechanism for loading ammunition, firing, and ejecting empty casings. The structure, shape and size of the receiver 103 may vary from weapon to weapon depending upon the loading and firing mechanism. Attached to the receiver 103 is a handgrip 105 or forestock 105, which is held by the non-shooting hand to steady and aim the weapon. Next, a barrel 107 extends from the receiver 103 to an exit point, or muzzle 109.

As shown in the prior art FIGS. 1A-1D, these simple components can be arranged in a variety of manners. FIG. 1A depicts a traditional lever-action rifle 101. In a lever-action rifle 101, the ammunition cartridge is loaded into the receiver 103 via a loading port on the side of the receiver 103, which places the cartridge in a magazine within the receiver 103. Next, the long gun or rifle 101 is "cocked" by pulling down on a lever near the trigger 111, and then pulling the lever back up. This causes spent casings to be ejected through an ejection port, and a new cartridge or round is loaded from the magazine into the firing chamber. The rifle 101 is then ready to shoot. The stock 105 is braced against the shoulder, the rifle 101 is elevated for sighting, and the trigger 11 is pulled to fire.

FIG. 1B depicts a bolt-action rifle 101. The overall structure is similar to a lever-action gun, except that instead of a lever to eject and load ammunition, an elongated bolt attached to the receiver 103 is used. To load the rifle 101, the bolt lever is rotated and pulled backwards, causing empty casings to be ejected. Next, a magazine is placed below the breech through the stock, or a built-in magazine is loaded with ammunition. Next, the bolt is pushed forward and then rotated closed, which causes the bolt head to strip a bullet from the magazine and place it in firing position. The rifle 101 is then braced and fired, similar to a lever-action rifle.

FIG. 1C depicts a semiautomatic rifle 101. A semiautomatic rifle 101 operates in essentially the same way as a lever or bolt-action rifle, except that, instead of a manually operated apparatus to eject empty casings and load the next round, this is done automatically. Semiautomatic rifles 101 allow each pull of the trigger 111 to fire the next round, without requiring the shooter to remove his or her hands or alter firing position to reload. This feature is desirable because, whether the shooter is in a combat situation, or simply hunting, the noise caused by firing will reveal the presence and location of the shooter. If the shooter must reload the rifle, he or she is exposed to danger from an enemy soldier or alarmed animal.

FIG. 1D depicts a different type of long gun 101, a pump-action shotgun 101. Shotguns 101 differ from rifles in that the ammunition is a shell full of small metal balls or "shot" which, when the shell is expelled, burst into a spread. Shot is commonly used when hunting birds, small mammals, or even large mammals. Shotguns 101 require less accuracy than rifles, and usually operate slightly differently than rifles, in that generally the shotgun round is loaded into the receiver, and then the forestock 115 is pumped back to eject empty casings, and pumped forward to load the new round. Traditionally, loading is done by "break action" where the stock of the weapon 101 rotates away from the receiver 103 to expose the back of the barrels 107.

Long guns have a number of advantages over handguns. Long guns generally have more accuracy because the shooter braces the weapon in three locations: the stock, the forestock, and the trigger. In addition, the longer barrel of a long gun improves sighting. However, long guns are physically larger, have a larger mass, and are generally more tiring to carry. Further, long guns have an increased moment of inertia, which makes them slower and more difficult to traverse and elevate for aiming, lowering response time.

Additionally, because of the overall length of a long gun, when the gun is carried over long distances, the weight can cause fatigue. To alleviate this, aftermarket products such as tactical slings are sold which attach to the gun and allow it to be slung over the shoulder or carried on the back. This can both alleviate fatigue, and free the hands for other purposes. However, these slings also have a number of problems. First, if the gun is slung over the back or shoulder, it is not at the ready for firing. This, combined with the slower traverse time of a long gun, can cause the shooter to be unprepared for an emergent need to use the weapon. For example, a soldier ambushed in a combat situation may be unable to ready his or her weapon in time to defend himself or herself. If the sling holds the gun in a forward, ready position, such as in prior art FIG. 2, the position of the weapon is generally low, requiring both elevation and traverse time. If the sling holds the weapon too low, the muzzle can drag in the ground and become clogged or damaged, inhibiting performance.

Further, although some rifles are designed for use with slings, many are not. This can make it difficult to attach a sling to the weapon, requiring jury-rigged solutions such as a strap to wrap around the stock. However, since most commercially sold slings are designed for use with assault rifles, which have built-in attaching points (typically behind the trigger), attaching such slings to a traditional hunting rifle will cause the weapon to be carried too low. This can damage the weapon and increase the reaction time of the shooter because of the degree of elevation required. What is needed in the art is an apparatus for attaching to a rifle and providing a mounting point for a single point sling, which carries the weapon at a higher, ready height and angle.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein, among other things, is a device for providing a sling mounting point for a long gun comprising: a mounting member configured for mounting to the long gun; an attaching member configured for attaching a sling to the device at the attaching member; an extension arm extending between the mounting member and the attaching member; wherein the mounting member, the extension arm, and the attaching member generally form an L-shape; and the extension arm is dimensioned such that when the device is mounted to the long gun at the mounting member and a sling is attached to the device at the attaching member, the long gun hangs from the sling at a pre-determined elevation from vertical.

In an embodiment, the pre-determined elevation is about 45 degrees.

In another embodiment, the pre-determined elevation is between about 30 and about 45 degrees, inclusive.

In another embodiment, the pre-determined elevation is between about 15 and about 45 degrees, inclusive.

In another embodiment, the extension arm is dimensioned such that when the device is mounted to the long gun at the mounting member and a sling is attached to the device at the attaching member, the long gun hangs from the sling at a pre-determined elevation from vertical when the long gun is empty of ammunition.

In another embodiment, the extension arm is dimensioned such that when the device is mounted to the long gun at the mounting member and a sling is attached to the device at the attaching member, the long gun hangs from the sling at a pre-determined elevation from vertical when the long gun is fully loaded with ammunition.

In another embodiment, the extension arm is dimensioned such that when the device is mounted to the long gun at the mounting member and a sling is attached to the device at the attaching member, the long gun hangs from the sling at a pre-determined elevation from vertical when the long gun includes an attached scope.

In another embodiment, the long gun is selected from the group consisting of: a hunting rifle; a military rifle; a lever-action rifle; a bolt-action rifle; a semi-automatic rifle; and a shotgun.

In another embodiment, the attaching member is an annular member.

In another embodiment, the long gun comprises a receiver and a forestock and the mounting member is configured to attach to the long gun between the receiver and the forestock.

In another embodiment, the mounting member is generally U-shaped.

In another embodiment, the attaching member further comprises one or more openings sized, shaped, and disposed on the attaching member for fitment via screws to corresponding holes in a receiver of the long gun.

In another embodiment, the mounting member is generally perpendicular to the attaching member.

Also described herein, among other things, is a device for providing a sling mounting point for a long gun comprising: a means for mounting the device to the long gun; a means for attaching a sling to the device; a means for disposing the attaching means such that when the device is mounted to the long gun by the mounting means and a sling is attached to the device by the attaching means, the long gun hangs from the sling at a pre-determined elevation from vertical.

In an embodiment, the pre-determined elevation is about 45 degrees.

In another embodiment, the pre-determined elevation is between about 30 and about 45 degrees, inclusive.

In another embodiment, the pre-determined elevation is between about 15 and about 45 degrees, inclusive.

In another embodiment, the disposing means is configured such that the long gun hangs from the sling at the pre-determined elevation from vertical when the long gun is fully loaded with ammunition.

In another embodiment, the disposing means is configured such that the long gun hangs from the sling at the pre-determined elevation from vertical when the long gun includes an attached scope.

In another embodiment, the long gun is selected from the group consisting of: a hunting rifle; a military rifle; a lever-action rifle; a bolt-action rifle; a semi-automatic rifle; and a shotgun.

DESCRIPTION OF THE PREFERRED EMBODIMENT(S)

The following detailed description and disclosure illustrates by way of example and not by way of limitation. This description will clearly enable one skilled in the art to make and use the disclosed systems and methods, and describes several embodiments, adaptations, variations, alternatives and uses of the disclosed systems and methods. As various changes could be made in the above constructions without departing from the scope of the disclosures, it is intended that all matter contained in the description or shown in the accompanying drawings shall be interpreted as illustrative and not in a limiting sense.

Generally speaking, the device described herein includes a mounting member configured for mounting the device to the long gun, and an attaching member configured for attaching the sling to the device. The device typically has an overall L-shaped configuration, with the mounting member and attaching member disposed at opposing ends with an extension arm therebetween. The length of the extension arm is configured so that when the device is mounted to the gun, the attaching member is disposed at a point along the major axis of the gun to cause the gun naturally to hang at an angle above vertical when hung from a sling attached to the attaching member. The angle is preferably around 45 degrees and may be any range within 0-45 degrees.

Figure 3:
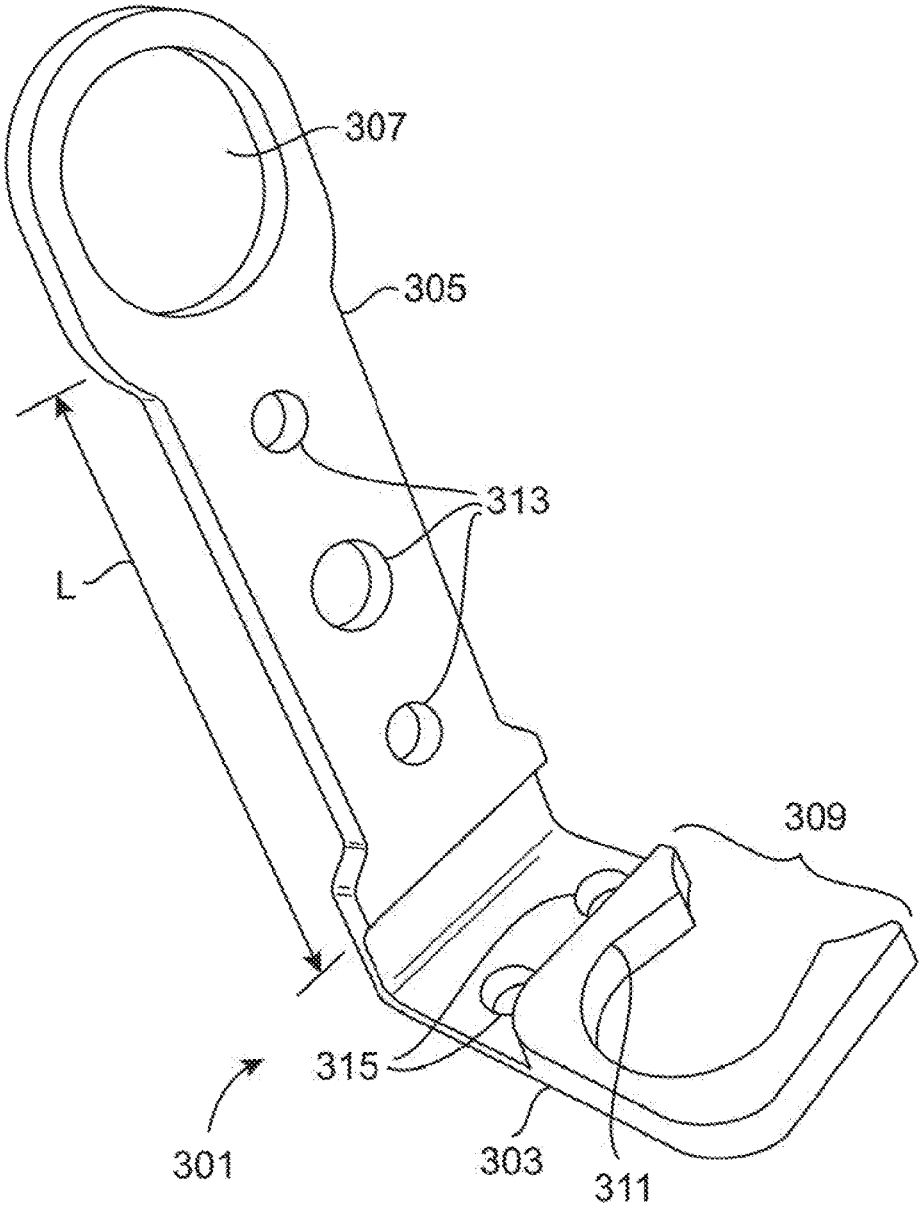
FIG. 3 depicts an embodiment of a device according to the present disclosure.

FIG. 3 depicts an embodiment of an apparatus 301 for providing a mounting point for a sling according to the present disclosure. The depicted apparatus 301 of FIG. 3 is configured for use with a lever-action rifle, but one of ordinary skill will readily appreciate that the device may be adopted for use with other types of weapons. As can be seen in the depicted embodiment of FIG. 3, the device 301 is comprised of three main components. First, the device 301 comprises an attaching member 307 configured for attaching a sling thereto. Second, the device 301 comprises a mounting member 309 configured for attaching the device 301 to a firearm. Third, the device 301 comprises an arm 305 of extension 305 disposed between the attaching member 307 and mounting member 309. The device 301 is generally in the configuration of an L, with the attaching member 307 and extension 305 forming the longer arm of the L, and the mounting member 309 forming the short bottom of the L. These and other elements will be described in more detail herein.

Figure 2:
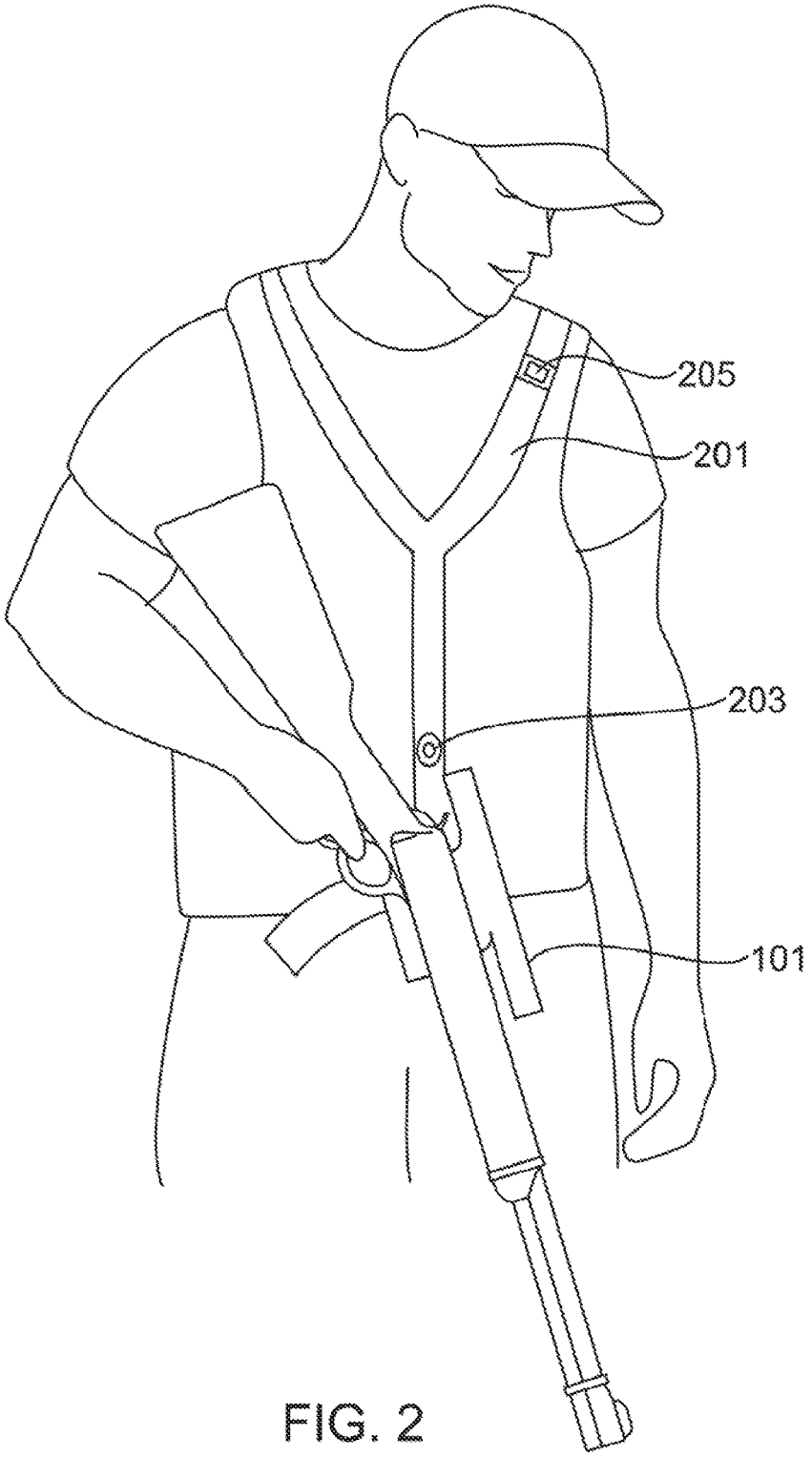
FIG. 2 depicts an embodiment of a soldier carrying a rifle with a single-point tactical sling in the prior art.

Prior art FIG. 2 depicts an embodiment of a single point tactical sling 201 appropriate for use with the device 301 described herein. The depicted sling 201 is adjustable to accommodate the height of the shooter, generally using adjustable straps clips 205 of a familiar kind. The sling 201 is attached to a mounting point on a firearm using a clip or spring snap 203.

In the depicted embodiment of FIG. 3, the device 301 comprises attaching member 307 in the configuration of an annular component disposed at a distal end of the extension 305. The depicted ring 307 has a hollow center. The diameter of the ring 307 is configured so that the corresponding attaching mechanism of the sling can be attached to the ring 307. Most slings use a clip or spring snap, which is opened, inserted through the ring 307, and then closed. The technique for using such a clip with a ring 307 such as that depicted in FIG. 2 will be familiar to one of ordinary skill in the art.

Figure 1A:
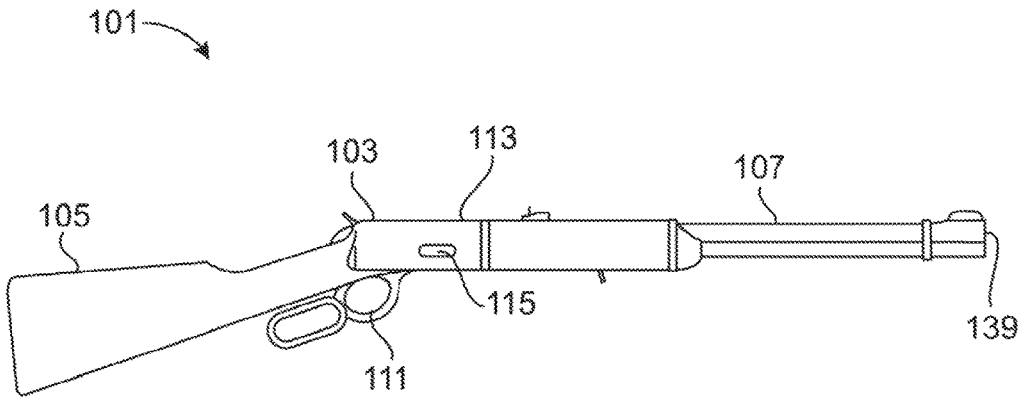
FIG. 1A (PRIOR ART)
FIG. 1A depicts an embodiment of a prior art lever-action rifle.
Figure 1B:
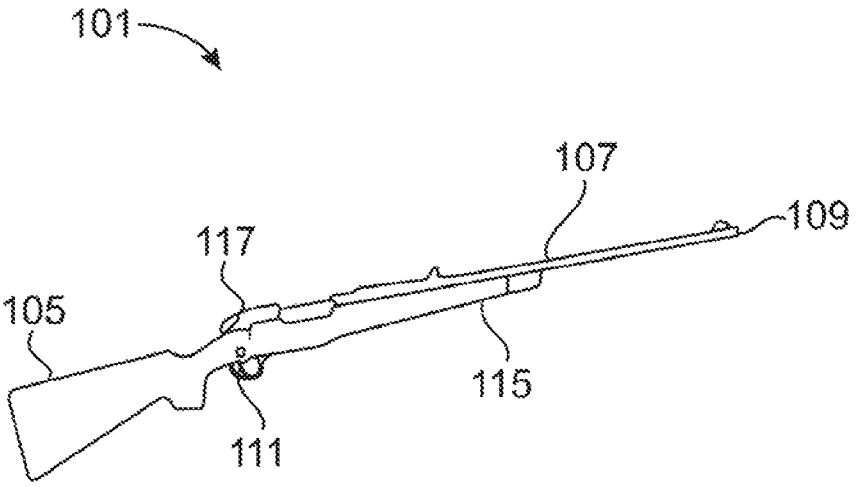
FIG. 1B (PRIOR ART)
FIG. 1B depicts an embodiment of a prior art bolt-action rifle.
Figure 1C:
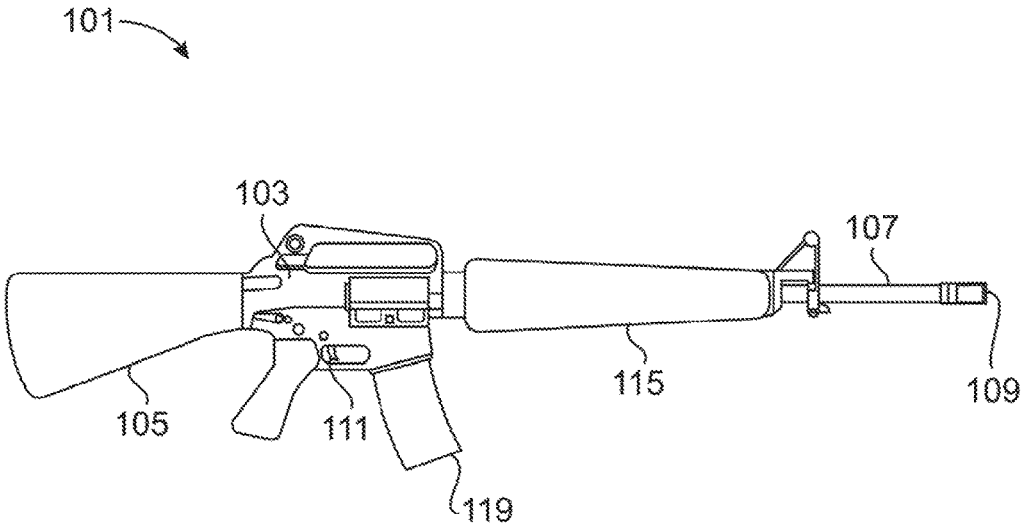
FIG. 1C (PRIOR ART)
FIG. 1C depicts an embodiment of a prior art semi-automatic rifle.
Figure 1D:
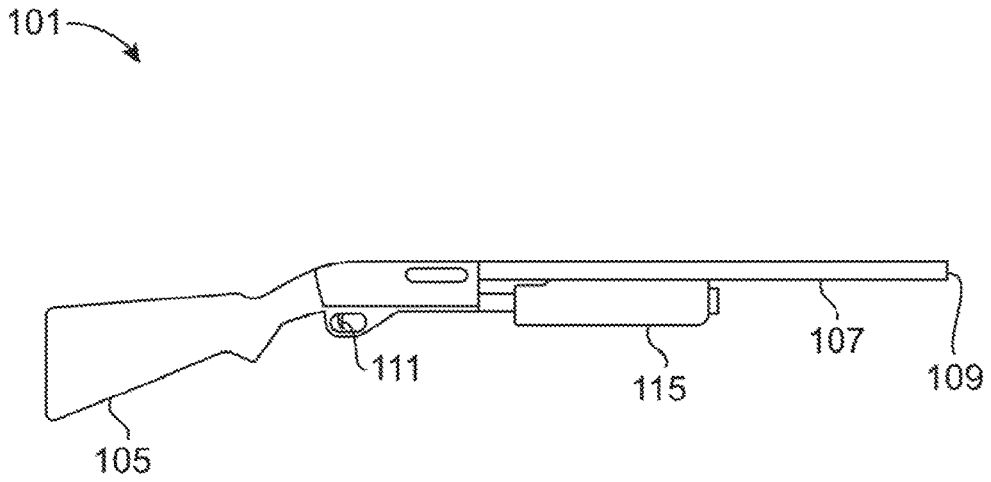
FIG. 1D (PRIOR ART)
FIG. 1D depicts an embodiment of a prior art shotgun.

At the opposing end of the device 301 from the attaching member 307 is the mounting member 309. The depicted mounting structure 309 is configured to attach to a lever-action rifle, such as that depicted in FIG. 1A by matching the contour, of the portion of the rifle 101 to which the device 301 is configured to be attached. In the depicted embodiment, for example, the mounting member 30 is a generally U-shaped, having a pair of outer flanges, matching the contour of a lever-action rifle 101 between the forestock 115 and receiver 103. An adhesive may also, or alternatively, be applied. In the depicted embodiment, the device 301 is attached to the rifle 101 between the receiver 103 and the forestock 115.

Figure 4:
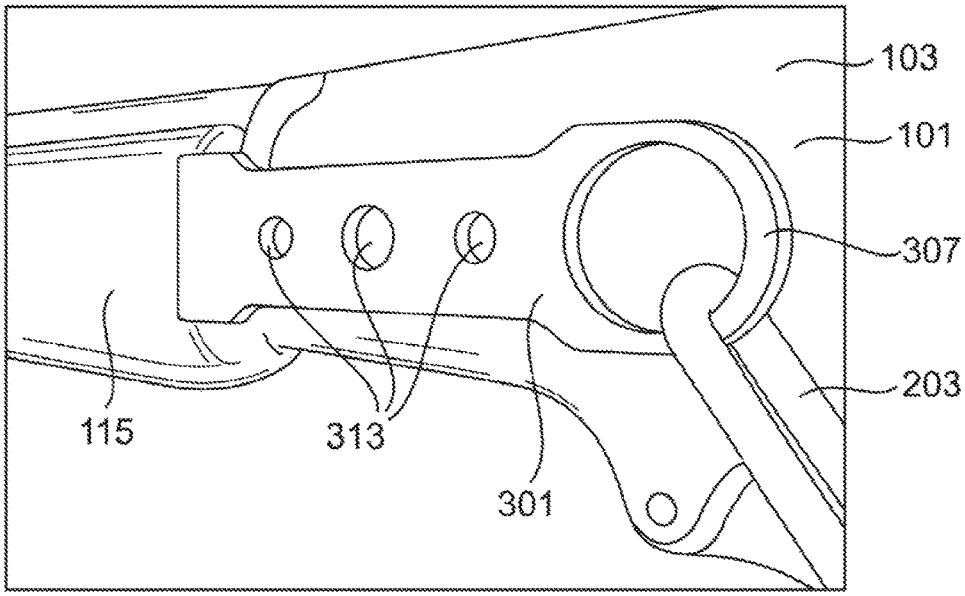
FIG. 4 depicts an embodiment of a device according to the present disclosure mounted to a rifle.

FIG. 4 depicts an embodiment of the device 301 installed on a rifle 101. In the depicted embodiment, the mounting member 30 is configured for attaching to the rifle 101 at a point between the receiver 103 and forestock 115. Hardware may be used to attach the device 301, such as by inserting pins, screws, or bolts through mounting holes 315 near the mounting member 309 and into the receiver 103. However, in the typical case, the snugness of the fit between the receiver 103 and forestock 115 provides sufficient friction to hold the device 301 in place. The major force vector typically acting on the device 301 during use is gravity, which may pull the device 301 toward the ground when the gun is elevated for aiming or firing, or towards the muzzle when the gun is carried. The mass of the device 301 is generally too small for the gravity to overcome the friction applied by the forestock and receiver during shooting, and the butt end of the stock holds the device 301 in place when the gun is carried.

The shape and configuration of the mounting member 309 will naturally vary from embodiment and embodiment depending upon the configuration of the particular model of gun 101 with which the embodiment is configured for use, and where on the particular model of gun 101 the device is 301 is configured to be attached. Generally, the device 301 is mounted on the gun 101 forward of the trigger. For most guns 101, the preferred mounting location is fore of the receiver 103. As such, mounting member 309 will often have a U-shaped element to match the contour of the barrel or forestock 115 at this location on the gun 101. However, it is self-evident that if the preferred mounting location on a particular model of gun 101 has a different cross-sectional contour, the size, shape, and configuration of mounting member 309 will of course vary to conform to that cross-sectional contour. The length of the rest of the bottom portion 303 is generally configured to cause the extension arm 305 and attaching member 307 to be displaced from the side of the gun 101 far enough to allow a sling clip to be attached to the attaching member 307. This dimension will also vary from embodiment to embodiment depending on the dimensions of the gun 101, and where on the gun the device 301 is configured to be mounted.

The length L of the extension 305 will generally vary from embodiment to embodiment, and the extension 305 is sized, shaped, and configured to, when then device 301 is attached to the weapon 101, cause the gun 101 to hang from a sling 201 attached to device 301 at the attaching point at about a 45° elevation from vertical (i.e., barrel-down). As explained in further detail elsewhere herein, this means that the dimensions and shape of the device 301 will necessarily vary from embodiment to embodiment depending upon the mass distribution of the rifle 101 for which the device 301 is configured for use, and optionally the anticipated or typical load-out of equipment attached to the rifle 101.

Figure 5:
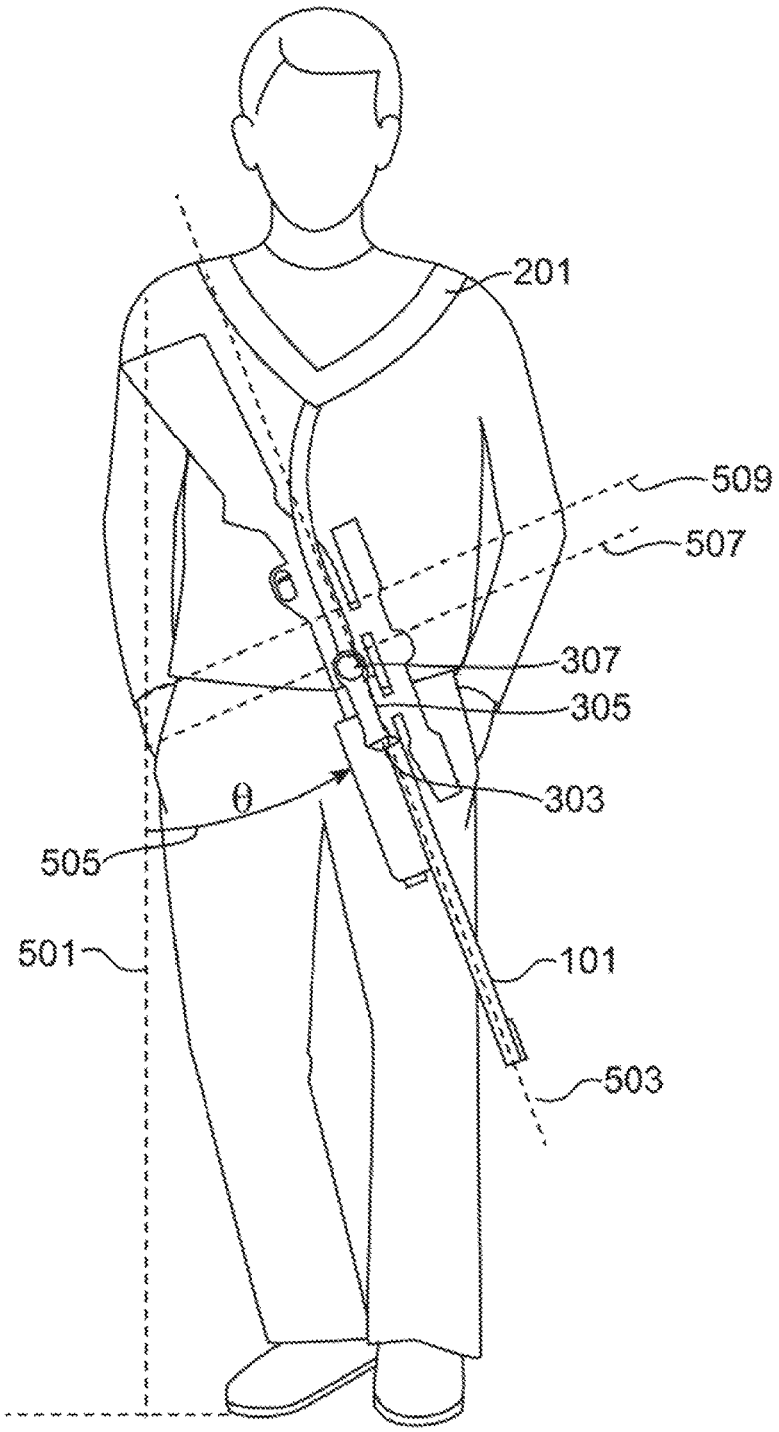
FIG. 5 depicts an embodiment of a device according to the present disclosure mounted to a rifle and used to hang the rifle from a single-point tactical sling at a natural elevation above vertical.

An exemplary embodiment is shown in FIG. 5. In FIG. 5*a* shooter is using the device with a sling 201 attached to a rifle 101. The device is attached to the rifle 101 and the sling 201 is clipped to the attaching member 307 of the device 304. Because the butt end of the rifle 101 contains the heavier components of the rifle 101, there is a point 509 along the major axis 503 of the rifle 101 at which the gun 101 will naturally rotate to vertical 501 (i.e., barrel-down, or parallel to the force of gravity) when suspended at that point 509. That is, if a single-point sling 201 is attached at that point 509 (or further), the pull of gravity on the mass of the gun forward of the point 509 will pull the gun's alignment to vertical 501 (e.g., overcome the inertia of the mass of the gun aft of point 509). The dimensions of the device are configured so that when the device is attached to the gun 101, the attaching member 307 is disposed at a point 507 fore of this "vertical hang" point 509. This causes more of the gun's 101 mass to be behind the point 507, elevating the major axis 503 above vertical. That is, the device configured for a given gun 101 so that, given the mass distribution of the gun 101, the natural "hang" angle is not vertical, but a pre-determined angle from vertical, such as approximately a 45° elevation from vertical.

It will be immediately apparent to one of ordinary skill in the art that the precise location of this point 507 will vary from gun to gun. Additionally, the mass distribution of an unloaded, off-the-shelf weapon in stock configuration differs from a loaded weapon. The weight of loaded ammunition, scopes, flashlights, and ammunition pouches can alter the mass distribution, which effectively moves point 507 along the major axis 503 of the gun 101. In an embodiment, the dimensions of the device 301 are configured to place the attaching member 307 at point 507 for a gun 101 when it is unloaded and unmodified with accessories. However, in an alternative embodiment, the dimensions of the device 301 are configured to place the attaching member 307 at point 507 for a gun 101 when it is at least partially loaded and/or modified with accessories. The weight and distribution of the accessories are naturally a matter of the shooter's taste and choice. As such, in the typical embodiment, the device 301 is configured to achieve maximum versatility by dimensioning the extension arm 305 so that the gun 101 achieves the pre-determined "hang" angle when the gun 101 is in its most common operational configuration.

Determining the dimensions of the device 301 needed to achieve the desired angle can be done mathematically, but, practically speaking, it is usually easier and simpler to determine it experimentally. This may be done by simply equipping a given model of gun for typical usage (e.g., loading ammunition and attaching commonly used accessories), and hanging the gun by a single point to determine point 507 under those conditions. For some guns, the addition of accessories and/or ammunition may alter point 507 enough that the gun 101 elevates much too high. In such circumstances, multiple devices 301 may be made for that model of gun 101, each designed for use with the gun 101 under different operational conditions (e.g., off-the-shelf vs. accessorized). Because a gun 101 is almost never carried empty, the device 301 generally is dimensioned for use with a gun 101 when the gun 101 is fully or at least partially loaded.

In an embodiment, the dimensions of the device 301 are configured to place the attaching member at point 507 for a gun when it is: unloaded (containing no live ammunition or spent casings); fully loaded with live ammunition; partially loaded with live ammunition and partially loaded with spent casings. In an embodiment, the dimensions of the device 301 are configured to place the attaching member at point 507 for a gun when it is accessorized with: a scope or sight; a flashlight; an empty ammunition pouch; a fully ammunition pouch. In an embodiment, the dimensions of the device 301 are configured to place the attaching member at point 507 for a gun when it is in any combination of the above-listed ammunition or accessorization states.

One of ordinary skill in the art will appreciate that consistently achieving exactly a 45° angle is a practical impossibility. As the gun 101 is used, live ammunition is replaced with empty casings, which are then ejected. This will change the mass distribution of the gun 101. Over the course of multiple firings, this change in mass distribution may be sufficient to move point 507 far enough along major axis 503 that the angle θ will change during normal use. One of ordinary skill will further appreciate that some natural variance in angle θ is to be expected from gun to gun, and loadout to loadout. It is preferred that point 507 is determined with respect to achieving about a 45° angle, but in an alternative embodiment, less than 45° angle may be preferred to accommodate variance in operating conditions. Thus, the dimensions of the device 301 may be configured to place the attaching member 307 at a point 507 along the major axis 503 between the vertical point 509 and the 45° hang point for an empty, unaccessorized weapon. This allows the shooter to add accessories while still achieving a natural elevation angle θ above vertical.

Thus, in an embodiment, device 301 is configured and dimensioned to dispose attaching member 307 at a point 507 along major axis 503 causing the gun 101 to hang at an angle θ of greater than 0° and up to 45° from vertical (inclusive).

In an alternative embodiment, device 301 is configured and dimensioned to dispose attaching member 307 at a point 507 along major axis 503 causing the gun 101 to hang at an angle θ of between about 5° and about 45° angle from vertical (inclusive).

In an alternative embodiment, device 301 is configured and dimensioned to dispose attaching member 307 at a point 507 along major axis 503 causing the gun 101 to hang at an angle θ of between about 10° and about 45° angle from vertical (inclusive).

In an alternative embodiment, device 301 is configured and dimensioned to dispose attaching member 307 at a point 507 along major axis 503 causing the gun 101 to hang at an angle θ of between about 15° and about 45° angle from vertical (inclusive).

In an alternative embodiment, device 301 is configured and dimensioned to dispose attaching member 307 at a point 507 along major axis 503 causing the gun 101 to hang at an angle θ of between about 20° and about 45° angle from vertical (inclusive).

In an alternative embodiment, device 301 is configured and dimensioned to dispose attaching member 307 at a point 507 along major axis 503 causing the gun 101 to hang at an angle θ of between about 25° and about 45° angle from vertical (inclusive).

In an alternative embodiment, device 301 is configured and dimensioned to dispose attaching member 307 at a point 507 along major axis 503 causing the gun 101 to hang at an angle θ of between about 30° and about 45° angle from vertical (inclusive).

In an alternative embodiment, device 301 is configured and dimensioned to dispose attaching member 307 at a point 507 along major axis 503 causing the gun 101 to hang at an angle θ of between about 35° and about 45° angle from vertical (inclusive).

In an alternative embodiment, device 301 is configured and dimensioned to dispose attaching member 307 at a point 507 along major axis 503 causing the gun 101 to hang at an angle θ of between about 40° and about 45° angle from vertical (inclusive).

While not preferred in the typical case, there may be operational scenarios in which an elevation angle θ of more than 45° is desired. It will be self-evident to one of ordinary skill in the art that the teachings of this disclosure can be adapted to dimension the device 301 to achieve such higher elevation angles θ.

In an embodiment, the device 301 comprises an adjustable extension arm 305, in which length L is adjustable to accommodate different operating conditions. Techniques for implementing adjustable length are known in the art and include, among other things, telescoping, ratcheting, and a sliding rail.

As can be seen in the FIGs., the mounting member 309 is configured to mount to the rifle such that the extension 305 and attaching point 307 are disposed on the left side of the receiver. However, in an alternative embodiment, this configuration may be reversed, so that the extension 305 and attaching point 307 are disposed on the right side of the receiver. Further, the extension 305 may comprise one or more openings or holes 313. Such openings may be sized and shaped to correspond to ports in the receiver, such as loading or ejection ports, and disposed on the extension at a location configured to correspond to such ports on the receiver when the device is installed on a rifle. This allows normal operation of the gun while the device is attached 301.

In a further embodiment, the holes 313 may be adapted for attaching an ammunition carrier to the exterior side, such as by snapping or fitting plastic dongles on the ammunition carrier to the holes 313.

In an embodiment, the mounting member 309 may comprise one or more movable or adjustable components, such as, but not necessarily limited to, a lockable ratcheting member. This may increase versatility and configurability and facilitating a tighter fit to accommodate natural variation in rifle dimensions caused by damage or natural variance from to manufacturing tolerances.

Techniques for manufacturing the device 301 are well-known. The device 301 is preferably made from a rugged, durable material, such as cold rolled steel, stainless steel, or aluminum. Additionally, additive manufacturing, also known as "3D printing," may be used with a polymer of sufficient strength and durability. The device 301 may be die-cast, but computer numeric control ("CNC") manufacturing is preferred. This process typically begins with a CNC laser cutting parts from a flat sheet of material. Once cut, the parts are loaded into a CNC mill, where the shoulder offset, mounting holes, and countersinking of the mounting screws for flush fitment are formed.

The present disclosure is made primarily with reference to a rifle, but it will be self-evident to one of ordinary skill in the art that the teachings of this disclosure can be adapted to dimension the device 301 to achieve the elevation angles described herein with respect to a shotgun or any other long gun, including but not necessarily limited to: hunting rifles, military or combat rifles, automatic rifles, single shot shotguns, double barrel shotguns, and over under shotguns.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A device for providing a single sling mounting point for a long gun comprising:

a mounting member configured for mounting to said long gun comprising a generally U-shaped element configured to engage the contour of said long gun at a position between the receiver and forestock of said long gun;

an attaching member configured for attaching a sling to said device at said attaching member;

an extension arm extending between said mounting member and said attaching member;

wherein said mounting member, said extension arm, and said attaching member generally form an L-shape;

wherein said extension arm is dimensioned such that when said device is mounted to said long gun at said mounting member and a sling is attached to said device only at said attaching member, said long gun hangs from said sling at a pre-determined elevation from vertical.

2. The device of claim 1, wherein said pre-determined elevation is about 45 degrees.

3. The device of claim 1, wherein said pre-determined elevation is between about 30 and about 45 degrees, inclusive.

4. The device of claim 1, wherein said pre-determined elevation is between about 15 and about 45 degrees, inclusive.

5. The device of claim 1, wherein said extension arm is dimensioned such that when said device is mounted to said long gun at said mounting member and a sling is attached to said device at said attaching member, said long gun hangs from said sling at a pre-determined elevation from vertical when said long gun is empty of ammunition.

6. The device of claim 1, wherein said extension arm is dimensioned such that when said device is mounted to said long gun at said mounting member and a sling is attached to said device at said attaching member, said long gun hangs from said sling at a pre-determined elevation from vertical when said long gun is fully loaded with ammunition.

7. The device of claim 1, wherein said extension arm is dimensioned such that when said device is mounted to said long gun at said mourning member and a sling is attached to said device at said attaching member, said long gun hangs from said sling at a pre-determined elevation from vertical when said long gun includes an attached scope.

8. The device of claim 1, wherein said long gun is selected from the group consisting of: a hunting rifle; a military rifle; a lever-action rifle; a bolt-action rifle; a semi-automatic rifle; and a shotgun.

9. The device of claim 1, wherein said attaching member is an annular member.

10. The device of claim 1, wherein said mounting member further comprises one or more openings sized, shaped, and disposed on said mounting member for fitment via screws to corresponding holes in a receiver of said long gun.

11. The device of claim 1, wherein said mounting member is generally perpendicular to said attaching member.

* * * * *